US005324038A

United States Patent [19]

Sasser

[11] Patent Number: 5,324,038

[45] Date of Patent: Jun. 28, 1994

[54] GOLFER'S MONITORING SYSTEM

[76] Inventor: Thurman Sasser, 1220 White Oak Creek, Left, Burnsville, N.C. 28714

[21] Appl. No.: 728,263

[22] Filed: Jul. 10, 1991

[51] Int. Cl.[5] ..... A63B 69/36

[52] U.S. Cl. ..... 273/183.1; 273/187.2; 273/189 R; 434/252

[58] Field of Search ..... 273/35 R, 183 R, 183 B, 273/186 R, 186 C, 188 R, 189 R, 54 B, 26 C, 29 A, 186.1, 187.2; 434/252; 128/782; 473/59, 62

[56] References Cited

U.S. PATENT DOCUMENTS

| | | | |
|---|---|---|---|
| 2,064,603 | 12/1936 | Harrison | 273/183 B |
| 3,350,100 | 10/1967 | Carmines | 273/54 B |
| 3,717,857 | 2/1973 | Evans | 273/183 B |
| 3,918,721 | 11/1975 | Trask, Jr. | 273/189 R |
| 4,017,086 | 4/1977 | Washburn | 273/189 R |
| 4,502,035 | 2/1985 | Obenauf et al. | 273/183 B |
| 4,527,982 | 7/1985 | Salzman et al. | 273/29 A |
| 4,660,829 | 4/1987 | Whiteneir | 273/29 A |

FOREIGN PATENT DOCUMENTS 231711 11/1968 U.S.S.R. ..... 128/782

OTHER PUBLICATIONS

R. M. Little et al., "Wrist & Shoulder Motion Analyzer," Research Disclosure, Nov. 1981, No. 211, pp. 404, 405.

*Primary Examiner*—Jessica J. Harrison

*Attorney, Agent, or Firm*—Arthur G. Yeager

[57] ABSTRACT

A device for monitoring a golfer's errant hand movements involves a hand position sensing element, a circuit for establishing a circuit condition which is indicative of a preferred hand position, a circuit for detecting changes in the established circuit condition and providing outputs that are indicative of errant pivotal hand movements, and a signals generating circuit for providing perceivable signals that are indicative of such errant movements. Various circuit controls are provided in the device and a training system is disclosed.

13 Claims, 7 Drawing Sheets

GOLFER'S MONITORING SYSTEM

BACKGROUND OF THE INVENTION

This invention relates to monitoring devices and to training systems for use in monitoring and correcting errant hand movements of a golfer and more particularly to monitoring errant hand movements during a swing of a golf club by a golfer.

Devices for monitoring the movement of one limb with respect to another of an athlete are known in the art. Harrison (U.S. Pat. No. 2,064,603) shows a wrist mounted device with an audio output that is used for monitoring movements of a golfer's power arm during a swing of a golf club. Trask (U.S. Pat. No. 3,918,721) shows a club mounted device with an audio output that is used for monitoring wrist movements of a golfer's leading arm during a golf club swing. Butler (U.S. Pat. No. 3,861,688) shows an arm mounted device with an audio output for monitoring wrist movements on the golfer's leading arm. DeMascolo (U.S. Pat. No. 4,222,569) places a spring steel snapper in a strategically located pocket of a glove or limb wrap that may be mounted on a golfers arm to provide an audio output when there is errant wrist movement. Bittner (U.S. Pat. No. 4,193,065) shows a leading arm mounted device with an audio and light output that is designed to signal errant movements of the elbow during a golfer's club swing. Salzman (U.S. Pat. Nos. 4,392,830 and 4,527,982) show a body mounted device for monitoring head movements that result in an audio output from an earphone worn by the athlete. Harrison (U.S. Pat. No. 4,743,028) has a power arm mounted device for signalling movement of the upper arm away from the golfer's body during a golf swing.

Other devices for monitoring an athlete's limb movements are also evident in the art. Murray (U.S. Pat. No. 4,488,726) shows a glove with pressure sensitive switches that are used in an audible alarm circuit for detecting errant limb movements. Evens (U.S. Pat. No. 3,717,857) has a limb attachment that is equipped with an accelerometer and strain gage for monitoring movements of a limb and where a signal bearing the errant movement information is transmitted by an rf carrier to a location apart from the athlete for recording or display purposes. Whiteneir (U.S. Pat. No. 4,660,829) has a device for monitoring a tennis player's wrist movements and which provides for delivering different audible signals in varying intensities from an earphone provided the athlete, the signals delivered being different for errant movements of the wrist in opposite directions from a predetermined center position and more intense or louder as the deviation of the errant movement from the center position becomes greater. Kleinerman (U.S. Pat. No. 4,330,123) has an device for monitoring arm movements of a bowler and where a audio sound is produced if the bowler executes the ball delivery without errant movements. Brunner (U.S. Pat. No. 4,911,441) has a racket mounted device for monitoring the players swing and comparing it with computer recorded swing information, provisions being made to provide audible and visual signals that indicated compatibility or incapatability between the monitored swing movements and recorded swing information.

Most of the prior art monitoring devices lack an effective or practical means for establishing a reference position for the limb movement being monitored. In those cases where a reference position can be established for operation of the monitoring device and where the reference position can also be changed to accommodate the needs of the player, the errant limb movement signals become perceivable as soon as the reference position is vacated by the limb being monitored. Thus, there is an intolerance in known devices for deviations from the reference positions.

Furthermore, many of the prior art approaches are considered universally applicable for use in all sports that involve limb movement when in fact the errant movements of a limb being monitored in playing one sport are usually quite different from those in another sport. Thus, the problems involved in the monitoring of a golf club swing are different from those encountered in tennis or baseball.

Another shortcoming in the use of prior art monitoring systems is the lack of regard for independent observers or teachers and almost total reliance upon the athlete's determinations. Most devices rely solely on the user's judgment for making an adjusting response to the errant movement detected by use of the monitoring devices when, in fact, the errant movement may be a compensating movement caused by an errant and unmonitored movement in yet another part of the body. Thus, a proper shifting of the body weight from one foot to the other is as equally important during a golf club swing as is the maintenance of a parallel relationship between the back of the hand and axis of the leading arm used in the swing. The student golfer who relies solely on a monitoring device for corrective information is frequently mislead by the seemingly errant movements detected thereby.

SUMMARY OF THE INVENTION

The instant invention is specifically concerned with monitoring errant movements of a golfer's leading hand during a swing of a golf club and to monitoring devices and training system for use in monitoring and correcting such errant hand movements.

In accord with certain aspects of the invention, a monitoring system or device is provided with a circuit for establishing a reference position for the leading hand with respect to the forearm connected thereto. This reference position is used in monitoring pivotal positions assumed by the hand during the swing of the club. These positions would include the reference position per se and those which are pivotally removed therefrom about a pivot axis that is through the wrist connection with the forearm and generally parallel to the plane of the hand.

A sensing device is provided for sensing the pivotal hand positions assumed during the swing and an errant position detector which is controlled in its response by the sensing device is provided for detecting such of the sensed pivotal hand positions as are pivotally removed from the reference position by an angle that exceeds a predetermined angle. The errant position detector also serves to detect the direction of errant pivotal hand movement from the reference position.

A signal generating system which operates under the control of the hand position detector circuit is also provided in accord with this aspect of the invention. The signal generating system responds to the detecting means by generating signals which are indicative of errant hand movements that have been detected as being removed from the reference position. These generated signals are respectively indicative of errant movements in the opposite directions from the reference position.

Certain aspects of the invention contemplate a manipulatable means for changing the angular relation between the reference position for the hand and the forearm, while other aspects of the invention contemplate a manipulatable means for changing the angle between the reference position and that at which pivotal movement from the reference position is detected.

The generated signals in accord with certain aspects of the invention may be humanly detectable light or audio signals or may be some other humanly perceivable signal such as a humanly detectable vibration or movement that is perceivable by the human senses. In accord with other aspects of the invention the generated signals indicative of the errant movements are electronic signals that are suitable for transmission by radio or light frequency transmission devices and thereafter translated to humanly detectable signals indicative of the errant hand movements.

Certain aspects of the invention are concerned with providing a training system which includes a monitoring device with a body supported unit that is carried by the golfer and an auxiliary unit that is located apart from the golfer and preferable carried by a golf instructor so that the instructor can monitor the errant hand movements of the student golfer. As such, provisions are made, in accord with these aspects of the invention, for the generation of signals which are indicative of the errant hand movements and for the transmission of such signals from the body supported unit to the auxiliary unit. Provisions are accordingly made in the auxiliary unit for receiving the transmitted signals and for amplifying the signals to provide appropriate signals which are perceivable by the instructor.

Other aspects of the invention are concerned with limiting access to the errant hand movement information by the student golfer and to placing the control of such access to the information in the hands of an instructor. As such, provisions are made for retransmitting the signals which are indicative of the errant hand movements and received at the auxiliary unit back to an ancillary body supported unit that is carried by the golfer. The ancillary unit under such circumstances is equipped with a receiver for receiving the retransmitted signals and for amplifying or otherwise generating humanly perceivable signals which are indicative of the errant hand movements from the received signals. In addition to the signals transmitter, switching means are also provide at the auxiliary unit for controlling the retransmission of the errant hand movement information to the ancillary unit carried by the golfer.

The above signal transmissions may be accomplished through the use of radio frequency transmitters and receivers or through the use of light transmission and receiving devices as will be seen subsequently.

A general object of the invention is to provided improved systems and devices for use in the monitoring of errant hand movements by a golfer during the swing of a golf club. Another object is directed to providing improved devices for determining the correct hand position for a golfer to use during the golf club swing. Still another object is to provide an improved system for teaching golfers proper hand movements during the swing of a golf club. Another object is provide an improved system of the kind contemplated in the prior object and in which the positions assumed by the golfer's leading hand may be monitored during the golf swing by either the student golfer or the instructor, or by both. Other objects of the invention will be evident from the disclosure which follows.

BRIEF DESCRIPTION OF THE DRAWINGS

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

DESCRIPTION OF THE PREFERRED EMBODIMENTS

FIGS. 1-6

Figure 1:
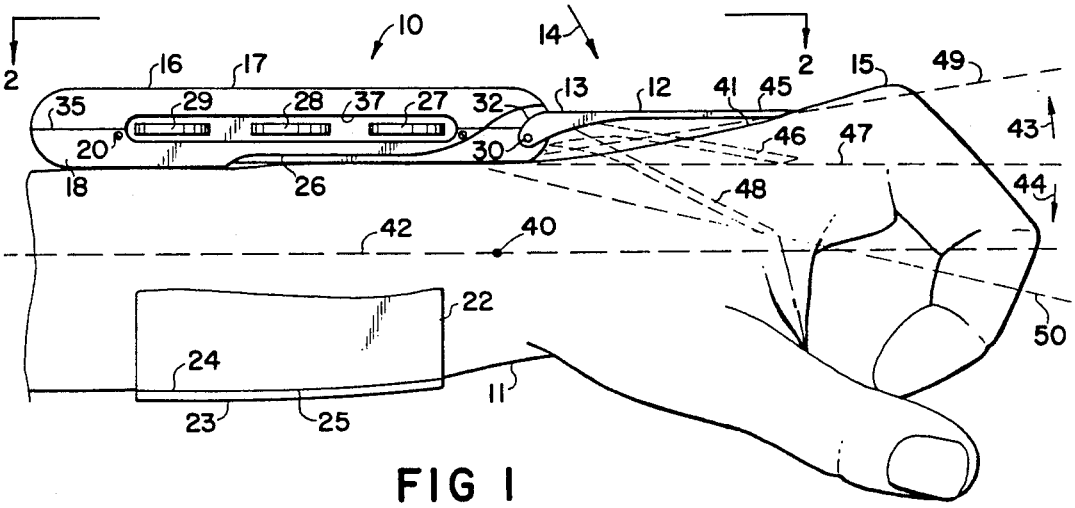
FIG. 1 illustrates a monitoring device embodying certain principles of the invention, the device being seen as attached to the leading forearm of a right handed golfer, a sensing element of the device being shown in contact with the hand of the golfer while still other positions assumable by the element are illustrated in broken lines, certain other parts of the device being broken away.

Reference is first made to FIGS. 1-6 and wherein a case 16 that may be used for housing certain components of the various monitoring device embodiments that are illustrated herein is shown in FIG. 1 as attached to and supported by the forearm 11 of a student golfer. The case 16 is equipped with a spring biased hand position sensing element 13 and with three manipulatable elements 27, 28, and 29 that are used in manually controlling certain circuit elements which are common to the various embodiments to be described.

FIG. 1 shows use of the case 16 in a monitoring device which is generally designated at 10. The monitoring device 10 is equipped with a sensing component 12 that includes the hand position sensing element 13. The element 13 is pivotally mounted on the case 16 and constantly biased in the direction of arrow 14 (FIG. 1). The biasing arrangement constantly urges the element 13 into contact with the back of the golfer's hand 15 when the case 16 is properly secured on the golfer's forearm 11 in the manner seen in FIG. 1. The case 16 has top and bottom parts 17 and 18 which define a hollow 19 (FIG. 2) for housing other parts of the device 10 when the components of the monitoring device are assembled and mounted in the case.

The bottom part 18 of the case has a pair of broadly U-shaped hangers 20 and 21 that are formed integral therewith and located at the opposite sides of the case 16. These hangers 20 and 21 are used to facilitate a connection to the case 16 of a pair of elongated flexible fabric bands 22 and 23 that are used in securing the case 16 to the golfer's forearm 11. Each of the bands 22 and 23 is secured at one of its ends to one of the hangers 20 and 21. At its other end, each band is equipped with one of the loop or hook parts of what is commonly called a "VELCRO" fastener. The loop and hook parts 24 and 25 are secured to the respective bands so that the loop and hook parts confront at the lower side of the forearm 11 and serve to fasten the bands 22 and 23 together during use of the monitoring device 10. The confronting hook and loop parts also fasten the case 16 to the forearm 11. Other means for fastening the case in position on the forearm may, of course, be used.

The sensing element 13 is a generally flat member which is pivotally connected to the bottom part 18 of the case 16 by means of a transverse pin 30 (FIG. 2) that is journalled at its opposite ends in a pair of blocks 31. These blocks 31 are spaced apart and located in the interior 19 of the case 16 and whereat they are integrally formed with the bottom part 18 of the case. The sensing element 13 has a pair of spaced apart ears 32 that are located at the opposite sides of the case 16. The opposite ends of the pin 30 project through the side walls of the bottom part and are fixed exteriorly of the case 16 to these ears 32 of the sensing element 13. A wheel 33 (FIG. 2) is fixed to the pin 30 within the hollow 19 and a flexible element 34 that is connected at one of its opposite ends to the wheel 33 is connected at its other end to a tension spring, not shown, but which is located in the hollow 19. This provides an arrangement for continually biasing the sensing element 13 and pin 30 in the direction of arrow 14 (FIG. 1) and thus into contact with the back of the hand 15 when the device 10 is in use.

The bottom part 18 of the case 16 has a flat exterior recess 26 which accommodates the location of the sensing element 13 when the monitor is not in use. The element 13 under such circumstances is pivotally urged under the applied biasing forces into the recess 26 and into facial contact with the bottom part 18 of the case.

Figure 2:
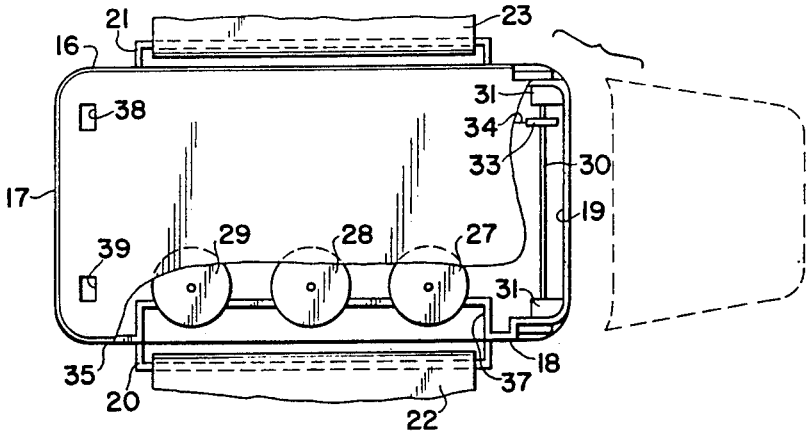
FIG. 2 is a top plan view of the monitoring device shown in FIG. 1 and as seen along the lines 2—2 therein, the top part of the case being broken away to expose certain control elements and the arrangement for pivotally mounting the sensing element, certain parts being broken away and/or shown in broken lines, and the player's body parts shown in FIG. 1 being obviously removed.
Figure 3:
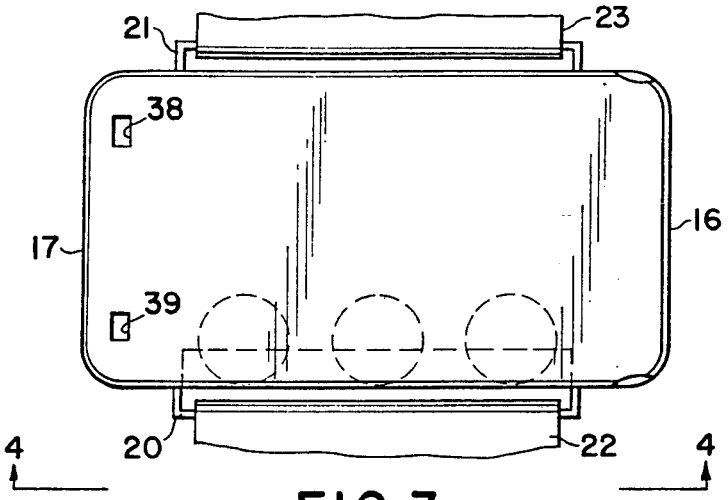
FIG. 3 is a top plan view of the device shown in FIG. 1, the sensing element being in an inoperative position, and certain components used in securing the device to the golfer's forearm being broken away.
Figure 4:
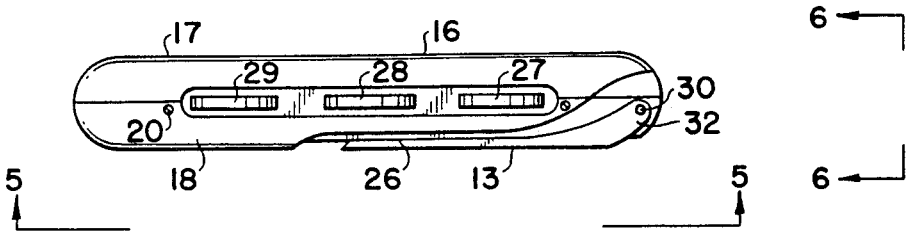
FIG. 4 is a side elevation view of the monitoring device shown in FIG. 1 and as seen along the lines 4—4 of FIG. 3, certain components used in securing the monitoring device to the golfer's forearm being broken away.
Figure 5:
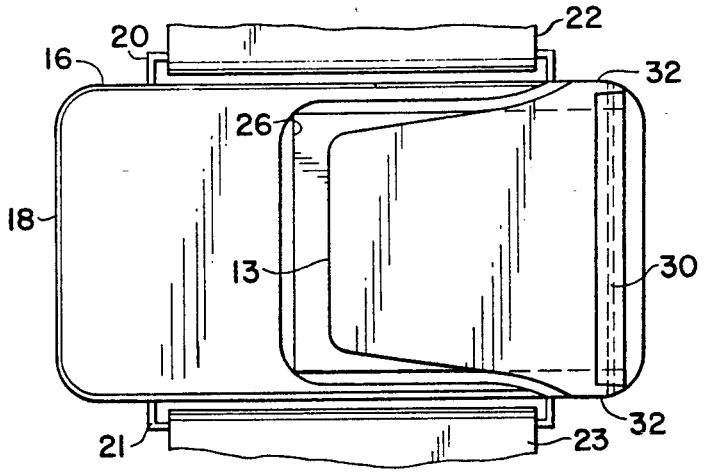
FIG. 5 is a bottom plan view of the monitoring device shown in FIG. 1 as seen with the sensing element in its inoperative position, the view being along the lines 5—5 of FIG. 4, certain components used in securing the monitoring device to the golfer's forearm being broken away.
Figure 6:
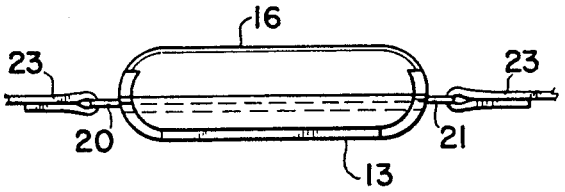
FIG. 6 is a end elevational view of the monitoring device shown in FIG. 1 and as seen along the lines 6—6 of FIG. 4, certain components used in securing the device to the golfer's forearm being broken away.

As seen in FIGS. 1 and 2, the sidewalls of the top and bottom parts are inset at one side 35 of the case 16 so as to facilitate the mounting of the three wheel like control elements 27, 28 and 29. The arrangement limits access to these control elements to a laterally opening slot 37 in the sidewall of the case 16.

Figure 7:
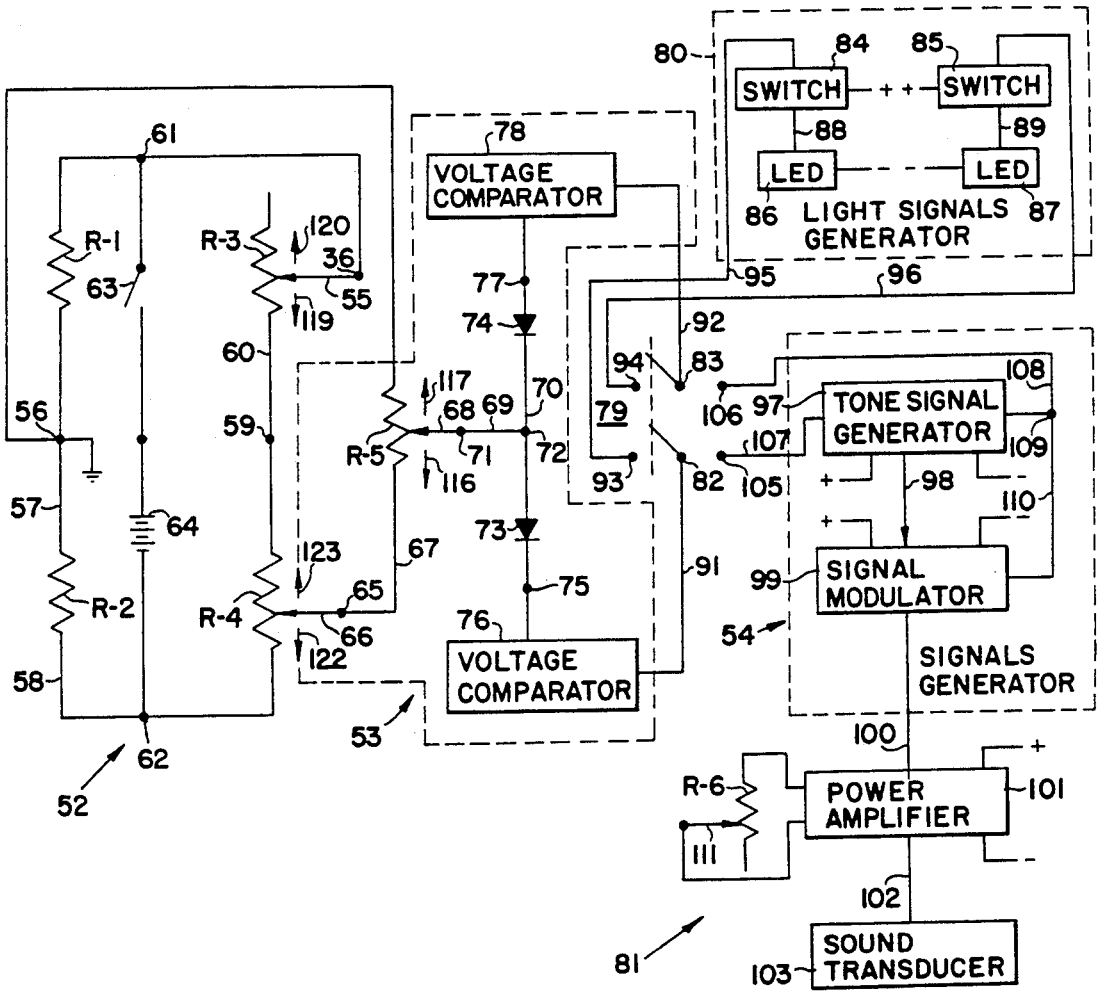
FIG. 7 is a circuit diagram showing the circuit arrangement of certain components of the monitoring device that are housed in the case of the embodiment shown in FIG. 1.

In the plastic case 16 illustrated in FIGS. 1-6, the top part 17 is provided with two transparent openings 38 and 39 (FIGS. 2-3) to permit certain light signals to be perceived by the golfer when the case is equipped internally with the circuit elements contemplated in FIG. 7. Appropriate indicia, such as the word "slice" and "hook" may be imprinted on the top part 17 adjacent the openings when the right handed or left handed characteristic of the contemplated user of the device is known. This may be done to indicate the results which would normally be expected by the errant movements being signaled through the transparent openings, as will be more evident subsequently.

As is apparent to most golfers, the usual objective in addressing a golf ball and then consummating the swing by backward and forward movements of the golf club is to effectively hit and drive the ball along a straight course or line of flight. It is well known that to accomplish this objective there is a need to control and limit the pivotal movements of the hand which is connected to the golfer's leading arm during the golf club swing.

Although a certain amount of pivotal movement of the hand is tolerable during the swing, it is usually only tolerated for purposes of cocking the wrist at the end of the backswing. Under such circumstances, the pivotal hand movement in cocking the wrist is about a pivot axis which generally extends through the wrist connection between the hand and forearm and which is perpendicular to the plane of the hand. On the other hand, pivotal movements of the hand about a pivot axis which extends through the wrist and in parallel with the plane of the hand are less tolerable. It is to the errant pivotal movements of the hand about this last mentioned pivot axis which is parallel to the plane of the hand that the instant invention is directed.

The pivot axis for most errant pivotal hand movements with which the invention is concerned is illustrated in FIG. 1 by reference to the dot 40. The axis extends perpendicular to the sheet of drawings and generally parallel to the plane of the hand. The plane of the hand may be considered as generally parallel to the back 41 of the hand 15 as seen in FIG. 1.

In practice, the objective during a golf club swing is to maintain the back 41 of the leading hand 15 in parallel with the axis 42 of the forearm 11 throughout both the backswing and foreswing of the golf club. With this in mind, it will be evident then that the objective is to maintain the hand 15 at what may be called a "null position" with respect to the forearm 11 and wherein the back 41 of the hand 15 is parallel to the axis 42 of the forearm. This null position is illustrated by broken line 47 in FIG. 1.

It will be apparent that, when considering a right handed golfer, the left arm is the leading arm during the swing while the right arm is the power arm. On the other hand, the reverse is the situation with a left handed golfer and wherein the right arm becomes the leading arm during the swing while the left arm is the power arm. The monitoring devices depicted and described herein are shown as mounted on the leading arm of a right handed golfer. However, the same device may be used by either a left handed or right handed golfer. As such, it may be used by the left handed golfer by appropriately mounting the device on the right arm of a left handed golfer, as will be apparent to those skilled in the art.

With the above in mind, for a right handed golfer, the null position for the hand may be indicated by reference to the position the hand assumes when the sensing element 13 assumes the position indicated at 46 in FIG. 1. Under such circumstances, the back 41 of the hand 15 is generally parallel to the broken line, designated at 47, and is also parallel to the axis 42 of the forearm 11.

When the leading hand 15 is pivotally moved in a forward direction from its null position during the swing of the golf club, such as to the position indicated by movement in the direction of arrow 43, there is a tendency for the ball to hook when struck by the club. A typical fore position for the leading hand under such circumstances would be that illustrated by the solid line hand position shown in FIG. 1 and whereat the sensing element 13 assumes the solid line position designated at 45 and the back 41 of the hand 15 generally falls along the broken line designated at 49.

On the other hand, when the leading hand 15 has pivotally moved in an aft direction from its null position at the time of ball contact, such as to the position indicated by movement in the direction of arrow 44, there is a tendency for the ball to slice when struck by the club. A typical aft position for the leading hand 15 under such circumstances would be that assumed when the sensing element 13 assumes the broken line position designated at 48 and whereat the back 41 of the hand 15 would generally fall along the broken line designated at 50.

FIG. 7

Reference is now made to FIG. 7 and wherein certain circuit components that are housed in the case 16 of the monitoring device 10 are illustrated. These include a circuit component 52 for establishing a circuit condition that is equatable to a null position for the leading hand 15 and which serves as a position for referencing pivotal movements of the hand about the pivot axis 40. The established circuit condition of the circuit component 52 changes in response to pivotal hand movements of the golfer which are sensed by the sensing element 13. To detect such changes in the circuit condition, a circuit component 53 for monitoring the circuit conditions is provided.

In detecting changes in the circuit condition, circuit component 53 provides circuit outputs which serve to indicate the position of the leading hand 15 in relation to the reference position that is established by the circuit component 52. These outputs, as will be seen, are indicative of errant pivotal hand movements in each of the opposite directions from the reference position that is established by the circuit component 52.

The monitor 10 also includes at least one signals generating circuit component that is responsive to the outputs of the circuit monitoring component 53. As will be seen, one of the signals generating circuit components may be a light signals generating circuit component that enables the golfer to determine the errant hand movement by visual means. Another component may be one which produces audible signals that enable the errant movements to be ascertained by sound perceptions.

The reference condition establishing circuit component 52 includes fixed resistors R-1 and R-2 which are connected in series to a grounded terminal 56 in one leg 57 of a parallel circuit that is designated at 58. This circuit component 52 also includes variable resistors R-3 and R-4 which are also connected in series, as seen in FIG. 7, to a terminal 59 in yet another leg 60 of the parallel circuit 58. The parallel circuit 58 includes the legs 57 and 60 and which are connected in parallel between the terminals designated at 61 and 62. As will be seen, these legs are resistively balanced when the circuit condition is indicative of the reference position for the hand.

As seen in FIG. 7, a dc power source 64 is also connected in parallel with the legs 57 and 60. Thus, terminal 61 is also connected to terminal 62 through a series connected on/off switch 63 and battery power source 64. Switch 63 is operatively connected in movement to control element 27 (FIG. 1). When the control element 27 is rotated in the clockwise direction (FIGS. 2 and 3) at the end of its limited range of counterclockwise movement, the switch 63 is moved from an "off" position to an "on" position. Conversely, when the control element 27 is rotated in the counter clockwise direction at the end of its limited range of excursion, the switch 63 is moved from an "on" position to an "off" position. This control element 27 also serves as a volume control element in an audio signals generating circuit which will be subsequently considered for the embodiment illustrated in FIGS. 1-7.

As seen in FIG. 7, terminal 61 is connected to the terminal 36 for the wiper blade 55 of the variable resistor R-3. This wiper blade 55 provides a controllable means for varying the condition of circuit component 52, and is connected in movement to the control element 28 of case 16. This arrangement permits the golfer to select a suitable null position for his hand and, with the hand in the selected position, to adjust the setting of the controllable wiper blade 55 so as to resistively balance the two legs 57 and 60 of parallel circuit 58. This establishment of the resistively balanced circuit condition in circuit 52 also serves to establish a reference position for referencing pivotal movements of the hand and which is equated to this selected hand position. Thereafter, any variance in the circuit condition which is detected by circuit component 53 will be for reasons of a pivotal movement of the hand which is sensed by element 13. These variations in the detected circuit condition will then be indicative of an errant pivotal hand movement in one or the other of the opposite pivotal directions from the null position.

The circuit component 53 for monitoring the condition of circuit component 52 includes a variable resistor R-5 with a resistance that is extremely large by comparison to any one of the resistors R-1 , R-2, R-3 and R-4. Resistor R-5 is connected between terminal 56 and the terminal 65 for the wiper blade 66 of variable resistor R-4, as is seen in FIG. 7.

Wiper blade 66 is a controllable means for varying the condition of circuit component 52 in response to pivotal hand movements that are sensed by element 13. It is connected in movement to the hand position sensing element 13 and forms an element of the component 12 for sensing the pivotal hand positions that are assumable during the golf club swing. The arrangement is such that the circuit leg 67 with the resistance for resistor R-5 and the wiper blade 66 serves, to monitor the polarity changes which occur between terminal 56 and the point of contact by the wiper blade 66 with the resistor of variable resistor R-4, as the leading hand 15 moves about the pivot axis represented by the dot 40 in FIG. 1.

The wiper blade 68 of variable resistor R-5 is connected to a polarity detecting circuit 70 of the monitoring circuit component 53 by means of a lead 69 that connects the wiper blade terminal 71 of the variable resistor R-5 with an input terminal 72 for a pair of diode components 73 and 74. These components 73 and 74 are arranged to form a polarity detector circuit 70 of the circuit monitoring component 53.

The wiper blade 68 is a controllable means for varying the response of the monitoring circuit 53 to those circuit conditions that are detected in circuit component 52 and indicative of errant pivotal movements of the hand in the opposite directions from the established reference position. Blade 68 is connected in movement with control element 29 and its movement serves to adjust the sensitivity of the monitoring circuit component 53 to changes in the condition of the reference position establishing circuit component 52. By diminishing the sensitivity of the circuit 53 to changes in the circuit condition of circuit 52, a greater variance from the resistively balanced condition that is indicative of the reference hand position is required before a responsive output for the circuit 53 is developed to enable a signals generator circuit.

The output of diode 73 is connected to the input terminal 75 of a voltage comparator 76 and the output of diode 74 is connected to the input terminal 77 of another voltage comparator 78. The voltage comparators 76 and 78 of the monitoring circuit 53 simply compare the negative and positive voltages which are applied to the comparators with a predetermined threshold voltage value of appropriate polarity and then provide a useful output to the signals generating circuits when the threshold value is exceeded.

When the polarity across circuit leg 67 is positive, the voltage is blocked by diode 74 but, nevertheless, passes diode 73 and is impressed on comparator 76. This results in an appropriate output in lead 91 when the threshold value is exceeded. When the polarity across leg 67 is negative, the voltage is blocked by diode 73 but passes diode 74 to be impressed on comparator 78. This results in an appropriate output in lead 92 when the threshold value is exceeded. The magnitude of the voltage impressed on the comparators is basically that which constitutes the voltage differential across the legs 57 and 60 less the voltage drop across the resistor of variable resistor R-5 in the circuit between terminals 65 and 71 in accord with the setting of the wiper blade 68 of the sensitivity selector arrangement. As such, when wiper blade 68 is moved in the direction of arrow 117, a greater imbalance in the parallel circuits is required before a threshold value in one of the comparators is realized. When the wiper blade is moved in the direction of arrow 116, the sensitivity is increased and a lesser imbalance in the parallel circuits will cause the threshold value in one of the comparators to be exceeded.

The circuit illustrated in FIG. 7 has a pair of signals generator circuits 80 and 81 that provide signals which may be perceived by the golfer. Circuit 80 responds by providing appropriate light signals that may be perceived by the golfer through an appropriate one of the transparent openings in case 16. Circuit 81 includes a tone signals generator circuit 54 that is connected through an amplifier 101 to a sound transducer 103 so as to provide appropriate audio signals that are perceivable by the golfer. Either circuit 80 or 81 may be selected to respond to the circuit outputs of the monitoring circuit 53 by appropriately setting a double pole, double throw switch 79 that is located in the interior 19 of the case 16.

The output of voltage comparator 76 is connected by lead 91 to the terminal 82 for one blade of the switch 79 and the output of voltage comparator 78 is connected via lead 92 to the terminal 83 for the other blade of the switch 79. Circuit 80 has a pair of switches 84 and 85 which are connected by respective leads 88 and 89 to light emitting diodes (LED's) 86 and 87 respectively. These switches 84 and 85 are connected to the respective blade contacts 93 and 94 of the switch 79 via leads 95 and 96. As such, when the switch blades are moved to one position for the switch 79, the blades contact switch contacts 93 and 94 and the light signals generator circuit 80 is connected for use in signalling the monitored results of the device.

Switch 84 is enable by the output from voltage comparator 76 and which is transmitted to the switch 84 via lead 91, switch 79 and lead 95. Switch 84 remains enabled as long as the comparator output is generated and it has a time delay that continues to cause the LED 86 to be energized for a predetermined time period after the comparator output is discontinued. As such, when switch 84 is enabled, a circuit is completed that energizes LED 86 during the generation of the comparator output and thereafter for a predetermined time interval (e.g. 10 secs.) following the discontinuance of the comparator output.

Similarly, switch 85 is enable by the output from voltage comparator 78 and which is transmitted to the switch 85 via lead 92, switch 79 and lead 96. Switch 85 also has a similar time delay system that opens the LED energizing circuit only after a predetermined time interval has lapsed following the discontinuance of the comparator output. Consequently, when switch 85 is enabled, a circuit is completed that energizes LED 87. This light source remains energized as long as the detected voltage is being impressed on comparator 78 and thereafter for a time interval determined by the switch 85 delay system. The light emitted by the LED's 86 and 87 may be viewed by the golfer through the case openings 38 and 39 respectively.

The audio signals generator circuit 81 includes the tone signal generating circuit 54. This circuit has a tone signal generator 97 with an output signal 98 that is supplied as the input to a signal modulator circuit 99. As will be seen, the signal modulator 99 is only rendered operative when the detected polartity is negative. As such, when the detected polarity is positive, the output signal 98 from the tone generator 97 passes through the modulator 99 without modification and then, via lead 100, to a power amplifier component 101 of the audio signals generator circuit 81. Here, the signal is amplified and passed by lead 102 to a sound transducer 103 of the circuit 81 and which is provided for producing perceptible audio signals. When the signal modulator 99 is operative the output signal 98 from the tone generator 97 is modified in the signal modulator 99 and then passed via lead 100 to the power amplifier 101 for amplification and passage to the transducer 103.

The tone signal generator 97 is connected to the blade contact 105 of switch 79 by lead 107 and the other blade contact 106 of the switch 79 is connected to the tone generator 97 by yet another lead 108. The signal modulator 99 is connected by lead 110 to a line tap 109 in lead 108 so that both the tone signal generator 97 and the signal modulator 99 are energized when a negative polarity exceeding the threshold value is detected.

With this arrangement, when the switch 79 is set for audio response by the signals generator circuit 81 to the monitoring circuit component 53, detection of a positive polarity across the leg 67 provides an output from the voltage comparator 76 for so long a period as the positive polarity is being detected. This output signal passes via lead 91, switch 79 and lead 107 to the tone signal generator 97 and where it serves to energize the generator 97 until the signal is discontinued. As such, the tone signal generator 97 generates an output signal 98 that passes through the signal modulator 99 without being modulated and then via lead 100 to the power amplifier 101. Here, the unmodified signal is amplified and passed via lead 102 to the sound transducer 103 where the unmodified tone signal is translated as an audible sound that is perceivable by the golfer.

Again when the switch 79 is set for an audio response by the signals generator 81, detection of a negative polarity across the leg 67 provides an output from voltage comparator 78 so long as a negative polarity in excess of the threshold value is being detected. This output is passed via lead 92, switch 79 and lead 108 to the tone signal generator 97 and, for reasons of the line tap 109 and lead 110, the output is also delivered to the signal modulator 99. As such, the output signal 98 of the tone signal generator 99 is modified in the modulator 99 and the modified signal passed via lead 100 to the amplifier 101 for amplification and passage via lead 102 to the transducer 103. Here, the modified tone signal is translated as an audible sound which is distinguishable by the golfer from the unmodified tone signal that is generated when the polarity is positive.

It should be noted that a variable resistor R-6 is provided to control the amplification in amplifier 101. The wiper blade 111 for this resistor R-6 is connected in movement to the on/off control element 27 and the arrangement is such that, as soon as the switch 63 closes during clockwise rotation of the element 27 (FIG. 2) to energize the monitor circuits, further movement of the control element 27 in the same direction increases the amplification of the amplifier 101. Conversely, counter clockwise rotation of the element diminishes the amplification until such time as the element 27 moves the switch 63 to the open circuit or "off" position.

The null position selector control element 28 controls the operation of the wiper blade 55 for the variable resistor R-3 and when this control element 28 is rotated in a counter clockwise direction (FIG. 2), the wiper blade 55 moves in the direction of arrow 119 (FIG. 7). Conversely, when the control element 28 is rotated in a clockwise direction, the wiper blade 55 moves in the direction of arrow 120.

The null position sensitivity control element 29 controls the operation of the wiper blade 68 for the variable resistor R-5 and when this control element 29 is rotated in a counter clockwise direction (FIG. 2) the wiper blade moves in the direction of arrow 116 (FIG. 7). Conversely, when the control element 29 is rotated in a clockwise direction, the wiper blade moves in the direction of arrow 117.

FIGS. 1, 2 and 7

Reference is now made to FIGS. 1, 2 and 7 for a consideration of the operational features of the circuit components of the device 10.

When the back 41 of the hand 15 is parallel with the axis 42 of the golfer's forearm 11, the back 41 of the hand 15 assumes a normally preferred null position for the golfer's leading hand during a swing of the golf club. This preferred null position is generally indicated by the broken line 47 in FIG. 1. Under such circumstances, the sensing element 13 assumes the position illustrated at 46 in FIG. 1. This will set the wiper blade 66 of variable resistor R-4 (FIG. 7) approximately midway between the opposite ends of the resistance element therefore. Thereafter, if the sensing element 13 moves in the clockwise direction indicated by arrow 44 from the position 46 illustrated in FIG. 1, the wiper blade 66 is moved in the direction of arrow 123 (FIG. 7). Conversely, if the sensing element 13 moves in a counterclockwise direction, such as illustrated by arrow 43 (FIG. 1), the wiper blade 66 is moved in the direction of arrow 122 FIG. 7). The sensing element 13 is biased into sliding contact with the hand 15 and as the hand 15 pivots about the axis 40, the sensing element 13 slides up and down the back of the hand.

Assuming again that the back 41 of the hand 15 is at the preferred null position indicated by the broken line 47 in FIG. 1 and that the wiper blade 66 of the variable resistor R-4 (FIG. 7) is located midway between the opposite ends of the resistor element therefor. Further assume that switch 79 is positioned to energize the light signals generator circuit 80 if an adequate voltage imbalance is detected in the parallel circuit 58. Now, if the sensitivity control element 29 is moved in a counter clockwise direction (FIG. 2) so that the wiper blade 68 of the variable resistor R-5 moves in the direction of arrow 116 and to the point at which the resistance between the terminals 65 and 72 is negligible, the monitoring circuit 53 will detect and be most sensitive to any unbalanced condition in the selector circuit 52. Any unbalanced condition that is then detected will, of course result in the energizing of an appropriate light signal from generator 80 and which is indicative of the imbalance and which can only be avoided by again reestablishing the balanced voltage condition in the parallel legs 57 and 60 of the circuit 58. As such, manipulation of the null position selector control 28 so as to move the wiper blade 55 of variable resistor R-3 to a position at which the voltage drop in each of the parallel circuit legs 57 and 60 is equal, as evidenced by the lack of any perceivable signal from the generator circuit component 80, will establish a circuit condition equatable to a null position for the leading hand 15 with respect to the forearm 11. Any pivotal movement of the hand 15 from this null position will now create an unbalanced condition that may be detected by the circuit monitoring circuit component 53 and result in a circuit output that causes the generation of an appropriate light signal which is indicative of an errant movement of the hand.

Now, if the golfer decides that a null position for the hand 41 other than that indicated by the broken line 47 is desired to perfect the golfer's swing, all the golfer has to do is pivot his hand 15 to the new null position which is desired during the golf swing. The golfer then, after making sure that the sensitivity control element 29 is in its most sensitive position, makes an appropriate adjustment in the null position selector control element 28 so as to create a balanced condition in the two legs 57 and 60 of the parallel circuit 58. This balanced condition can be detected by manipulating the control element 28 to a position at which the production of a perceivable signal indicating an errant position is avoided.

The general operation of the monitoring device 10 may best be understood if one assumes that a null position, such as that indicated in FIG. 1 by the broken line 47, has been first established in circuit 52 through the manipulation of control element 28.

Under such conditions, if the hand 15 pivots in the clockwise direction indicated by arrow 44 (FIG. 1) from the sensed null position 47, element 13 also pivots in the clockwise direction under the influence of the biasing forces applied to the element 13. By virtue of its connection with the wiper blade 66, the clockwise movement of the sensing element 13 moves the wiper blade 66 in the direction of arrow 123. This causes the bridge formed by the parallel legs 57 and 60 to become unbalanced and terminal 65 now becomes positive with respect to terminal 56.

This results in a current flow from terminal 65 through the resistor for variable resistor R-5 and to terminal 56. It also results in a current flow through the wiper blade 68 of variable resistor R-5 and to the voltage comparator 76 via the diode 73. If the voltage applied to the comparator 76 exceeds the threshold value, an output is sent via lead 91 to switch 79.

If switch 79 is set to energize the light signals generator 80, the output from the comparator 76 passes via lead 91, switch 79 and lead 95 to switch 84. The response by switch 84 is such as to energize LED 86 for viewing by the golfer through the transparent opening 38 in case 16. This would normally indicate that the detected errant hand movement would be productive of a slice.

If switch 79 is set to energize the audio signal generator 81, the output from the comparator 76 passes via lead 91, switch 79 and lead 107 to the tone signal generator 97. This activates the tone signal generator 97 and produces and output signal 98 that passes through the signal modulator 99 in an unmodified condition and via lead 100 to the power amplifier 101. Here the signal is amplified and then passed via lead 102 to drive a sound transducer 103 that produces an audible signal indicative of the errant hand movement which is normally productive of a "slice" by a right handed golfer.

Now, if the golfer's wrist pivots in a counter clockwise direction from the sensed null position 47, as indicated by arrow 43 (FIG. 1), lever element 13 also pivots in a counter clockwise direction under the influence of the forces applied to the element 13 by the pivotal movement of the hand 15. By virtue of its connection with the wiper blade 66, the counter clockwise movement of the sensing element 13 moves the wiper blade 66 in the direction of arrow 122. This causes the bridge formed by the parallel legs 57 and 60 to become unbalanced and terminal 65 now becomes negative with respect to terminal 56. This results in a current flow from terminal 56 through the resistor for variable resistor R-5 to terminal 65. It also results in a current flow from the voltage comparator 78 through diode 74 and to the wiper blade 68 of variable resistor R-5. If the voltage applied to the comparator 78 exceeds the threshold value, an output is sent via lead 92 to switch 79.

If switch 79 is set to energize the light signals generator 80, the output from the comparator 78 passes via lead 92, switch 79 and lead 96 to switch 85. Under such circumstances, the response by switch 85 is such as to energize LED 87 for viewing by the golfer through the transparent opening 39 in case 16. This would normally indicate that the errant hand movement detected would be productive of a "hook".

If switch 79 is set to energize the audio signals generator 81, the output from the comparator 78 passes via lead 92, switch 79 and lead 108 to the tone signal generator 97. This activates the tone signal generator 97 and produces and output signal 98 that is delivered to the signal modulator 99. By virtue of the tap 109 in line 108, the comparator output is also delivered, as via lead 110, to the modulator 99. This energizes the modulator 99 so that the output signal 98 from the tone generator 97 is modulated in the modulator 99 and, as thus modified, passes via lead 100 to the power amplifier 101. Here, the signal is amplified and passed via lead 102 to drive a sound transducer 103 that produces a signal indicative of the errant hand movement which is normally productive of a "hook".

One aspect of the invention has to do with the ability to adjust the sensitivity of the detecting circuit 53. The sensitivity adjustments are made by the manipulation of control element 29. When the element 29 is moved in the counter clockwise direction, wiper blade 68 is moved in the direction of arrow 116 and so that the resistance between the wiper blade terminals 65 and 71 is diminished. This produces the most sensitive condition and at which minimal movement of the hand from the null position will activate an appropriate signal indicative of the errant movement. On the other hand, movement of the control element 29 in the clockwise direction will move the wiper blade 68 in the direction of arrow 117 so that the resistance between the wiper blade terminals 65 and 71 is increased. This will diminish the sensitivity of the circuit 53 to unbalanced conditions in circuit 52 and require a larger voltage unbalance in the parallel circuit 58 before the circuit 53 responds and enables the appropriate signal generator.

The threshold voltages of the comparators involved are relatively small and of equal but opposite polarity. Under the most sensitive operating conditions established by the manipulation of control element 29, the threshold voltages determine the extent of the angular movement of the hand from the established null position which must occur before an unbalanced condition in the parallel circuit 58 will be reflected by an output from circuit 53 and which will enable the appropriate signal generator that is productive of a signal indicative of the errant hand movement. When the control element 29 is manipulated to provide a less sensitive operating condition, the resulting increase in resistance caused by the movement of wiper blade 68 in the direction of arrow 117 establishes a condition that requires not only that the threshold value of the comparator be overcome in order to provide an output from the circuit 53, but that the bridge circuit imbalance be sufficient to also overcome the voltage drop through the added resistance between the wiper blade terminals 65 and 71 before an output from the circuit 53 is developed. In effect, moving the control element 29 from its most sensitive position to a less sensitive position will increase the angle required for the hand to move from the null position established by the circuit 52 and to a position which is sufficiently pivotally offset from the null position to provide an output from the detecting circuit 53 that will cause the generation of an appropriate signal which is indicative of the errant pivotal movement.

The professional golfer occasionally goes into what may be termed a "slump" and is unable to attribute the less than satisfactory play to any one errant movement of a limb during his/her play. The golfer, under such circumstances, would want to critically analyse his/her hand movements during the swing of the club and to be appraised of the slightest errant movement that is occurring from what he/she considers his/her ideal null position.

Under such circumstances, the professional would set the detector circuit 53 to its most sensitive position for detecting errant hand movements during the golf club swing. This would be accomplished by rotating the control element 29 in the counter clockwise direction (FIG. 2) so as to diminish the resistance between the wiper blade terminals 65 and 71 to the point at which any unbalanced in the voltage across the legs 57 and 60 is, for practical purposes, immediately reflected by a potential that is impressed upon one or the other of the voltage comparators 76 or 78, depending, of course, upon the polarity determined by the polarity detector circuit 70.

The novice or beginning golfer, on the other hand, will initially want to experience some deviation in hand movement from the null position initially established in setting the circuit component 52 before he/she receives a signal indicative of an errant hand movement. This is understandable because the novice has many body parts to consider in developing the fluid body movements that are productive of a precision club swing.

As such, it would be normal for the novice to initially adjust the detector circuit 53 to a less sensitive setting for the detection of errant hand movements. This would be accomplished after setting the circuit 52 to establish the desired null position for the hand and by manipulating the control element 29 in the clockwise direction (FIG. 2) so as to move the wiper blade 68 in the direction indicated by arrow 117 (FIG. 7). This, in effect, increases the resistance between terminals 65 and 71 and dictates a need for a larger voltage differential to be developed across the legs 57 and 60 of the circuit component 52 before a voltage condition in excess of the threshold values can be impressed on the voltage comparator involved in the transmission by the polarity detector 70. As such, the response to an errant hand movement detected by circuit component 53 is controlled by the setting of the sensitivity selector control element 29.

It should be apparent, that as the novice gains experience in the use of the monitoring device 10 and in perfecting his golf club swing, the sensitivity selector control element 29 may be adjusted so that circuit 53 detects and responds to errant hand movements that are less deviating from the null position established by the circuit 52 than those detectable under sensitivity settings theretofore used.

It may be pointed out at this point that there are occasions when a hook or slice may be used to advantage by a skilled golfer. Examples, might be those which occur during negotiating a narrow fairway that contains a dog leg or when driving a ball around a tree in the center of the desired flight path. Under such circumstance, the golfer may make an adjustment in the control element 28 and which establishes a null position for the hand which would normally provide the desired slice or hook so as to accomplish the desired result. Thereafter, when the obstruction has been circumvented or the dog leg negotiated, the control element 28 may again be set to establish a null position for the hand which would normally provide for a straight line of flight for the ball.

FIGS. 8–11

FIGS. 8–11 illustrate a training system for use in correcting errant hand movements during a swing of a golf club by a golfer. In this system an instructor is capable of monitoring the errant movements of the student golfer and of controlling the output signals of the system that are indicative of such errant hand movements so that the student may or may not be directly appraised of such errant hand movements.

Figure 8:
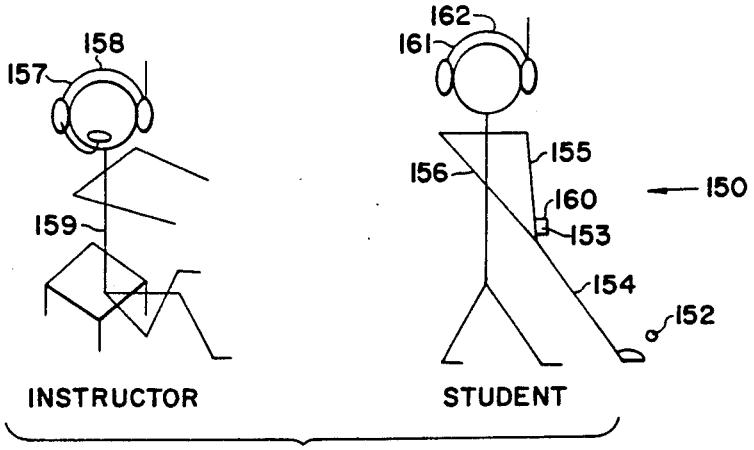
FIG. 8 illustrates a teaching system with a monitoring device for monitoring the student golfer's hand movements, the device including a primary unit that is carried by the student golfer, an auxiliary unit which is located apart from the primary unit and used by an instructor and an ancillary unit that is also carried by the golfer but which operates under the control of certain switching means embodied in the auxiliary unit.

The training system 150 is generally illustrated in FIG. 8 and wherein a student golfer 151 is depicted as addressing a golf ball 152. The golfer 151 is right handed so that the power arm is designated at 156 whereas the leading arm is designated at 155. The system 150 involves the use of a monitoring device 153 for monitoring the hand movements by the golfer 151 during a swing of the golf club 154. The monitoring device 153 has a primary unit 160 that is carried by the golfer and appropriately mounted and supported on the golfer's leading arm 155. The unit 160 includes a case substantially similar to that shown in FIGS. 1–6 and which is equipped with a sensing element for sensing the location of the hand with respect to its null position, as established by the circuitry of the monitoring device 153. In this embodiment, the case may be appropriately modified to provide an antenna for an rf transmitter as will be evident from what follows.

The monitoring device 153, in addition to the primary unit 160, includes an auxiliary unit 157 which is remote from the student 151 and thus located apart from the primary unit 160 carried by the student. The auxiliary unit 157, in the illustrated embodiment of the system 150, is incorporated in a headset 158 that is worn by the instructor 159 in the illustration. The instructor is capable of controlling the distribution of certain of the perceivable signals generated by the device 153 and to do this from by a switching component that is provided with the auxiliary unit. The auxiliary unit 157 is capable of receiving signals that are transmitted from the primary unit 160 and indicative of errant hand movements of the student golfer. The unit 157 is further capable of generating audio signals which are perceivable by the instructor and indicative of the errant hand movements of the student golfer.

In addition to the auxiliary unit 157, the monitoring device 153 also includes an ancillary unit 161 which is incorporated in yet another headset 162 that is worn by the student 151. As will be seen, the signals received by the auxiliary unit 157 may be retransmitted to the ancillary unit 161 for the generation of suitable signals which may be perceived by the student and are indicative of the errant hand movements.

As will be seen in this arrangement, signals indicative of errant hand movements by the student golfer 151 are transmitted from the primary unit 160 to the auxiliary unit 157. There, the instructor 159 monitors the signals indicative of the errant hand movements through an ear phone and, in his/her discretion, causes, through the suitable manipulation of a switch, the transmitted signals to be retransmitted to the ancillary unit 161 for monitoring by the student 151 through an ear phone component of the ancillary unit. The auxiliary unit 157 is also equipped with a microphone that enables the instructor to orally communicate directly with the student.

It should be understood that the primary unit 160 includes an arm mounted case with a sensing element which contacts and follows the back of the hand and which is substantially similar to that shown in FIGS. 1–6. With this in mind, reference is now made to FIG. 9 and to the components of the primary unit 160 of the monitoring device 153 which are shown therein.

Figure 9:
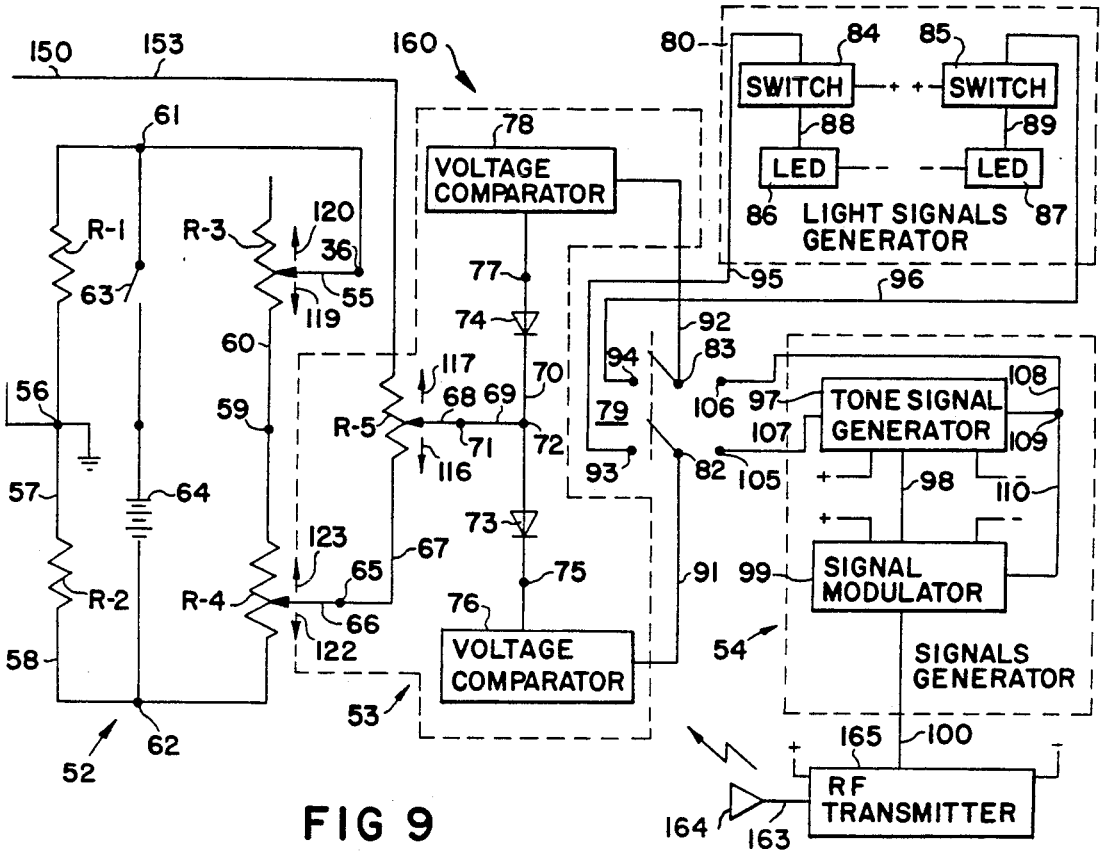
FIG. 9 is a circuit diagram showing the circuit arrangement of certain components of the primary unit of the monitoring device illustrated in the teaching system shown FIG. 8.

The circuit components shown in FIG. 9 which bear the same numerals as used in FIG. 7 are like those shown in FIG. 7 and they function the same way in the monitoring device 153 depicted in FIG. 9 as is described with reference thereto in considering the monitoring device 10 depicted in FIG. 7. Thus, the circuit components 52, 53, 54 and 80 in FIG. 9 are structurally identical to and function in the same manner as those components of the monitoring device 10 depicted in FIG. 7. They are also interconnected through a switch 79 in the same manner discussed in the consideration of device 10.

The principal difference between the arrangements depicted in FIGS. 7 and 9 lies in the treatment of the output signals that are delivered from the tone signals generator circuit 54. Thus, in the primary unit 160 of the monitoring device 153 depicted in FIG. 9, these signals are delivered by lead 100 to a radio frequency transmitter 165 that has an output which is delivered by a lead 163 to an antenna 164 that is appropriately provided at the exterior of the arm supported case. As such, the output signals of the tone signals generator 54 are transmitted to the auxiliary monitoring unit 157 for reception in the training system 150 depicted in FIGS. 8–11.

Figure 10:
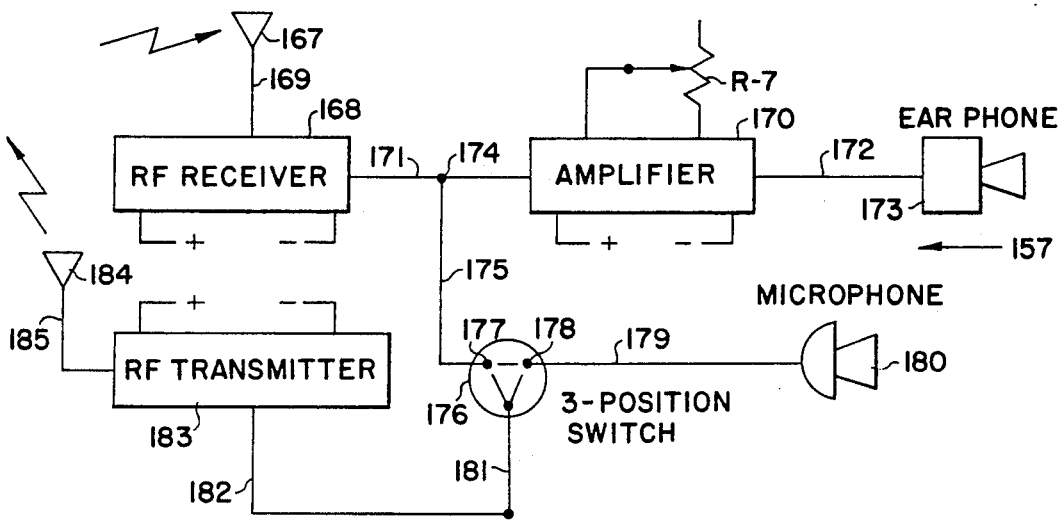
FIG. 10 is a circuit diagram showing the circuit arrangement of certain components of the auxiliary unit of the monitoring device that is used by the instructor in the teaching system depicted in FIG. 8.

The circuit components of the auxiliary monitoring unit 157 are shown in FIG. 10. Here, the unit 157 is provided with an antenna 167 that is connected by a lead 169 to a radio frequency receiver 168 which is tuned to the frequency of the carrier for the transmissions emanating from transmitter 165. The output of the receiver 168 is fed to an amplifier 170 via lead 171 and the amplified signals is passed via a lead 172 to an earphone 173 or other suitable transducer that enables the instructor to monitor the students hand movements. A variable resistor R-7 is provided for control of the amplifier 170 and by manipulating a suitable control element (not shown) on the headset 158, the instructor is capable of attenuating the output signal which is fed to the earphone 173.

Lead 171 has a wire tap 174 for delivering the receiver output via a lead 175 to one contact 177 of a three position switch 176. Another contact 178 of the switch 176 is connected by lead 179 to a microphone 180 that may be used by the instructor to orally communicate with the student golfer. The switch blade 181 of switch 176 is connected by lead 182 to a radio frequency transmitter 183 that operates on a different frequency from that used in the operation of the transmitter 165 of the primary unit 160. The output of the transmitter 183 is delivered to an appropriate antenna 184 by lead 185 for transmission to the ancillary unit 161.

Switch blade 181 has three positions. In one position, the blade is only in contact with switch contact 177. Under such circumstances, the output of the receiver 168 is delivered to the rf transmitter 183 for addition to the carrier used in transmitting the receiver output to the ancillary unit. In another position, the blade is only in contact with switch contact 178. Under such circumstances, the microphone is connected directly to the rf transmitter 183 so that the instructor can communicate directly with the student by rf transmissions emanating from the antenna 184 of the auxiliary unit 157. In the third position, the blade 181 is in contact with both of the switch contacts 177 and 178. As such, the instructor can communicated directly with the student while the student is simultaneously capable of perceiving signals which are indicative of errant hand movements and which have been retransmitted from the auxiliary unit 157 to the ancillary unit 161.

Figure 11:
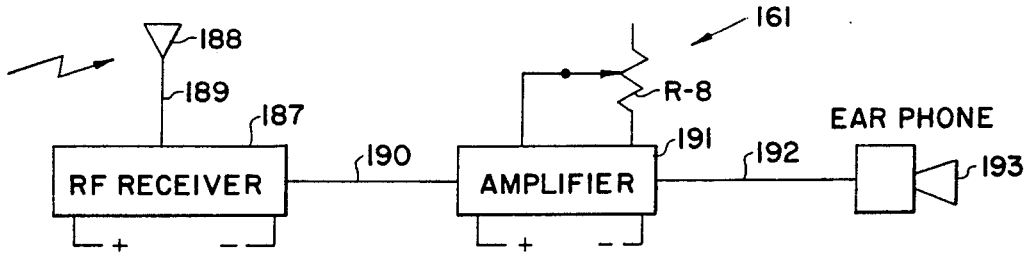
FIG. 11 is a circuit diagram showing the circuit arrangement of certain components of the ancillary unit of the monitoring device used in the teaching system illustrated in FIG. 8.

The principle components of the ancillary unit 161 are shown in FIG. 11. The unit 161 includes a radio frequency receiver 187 that is connected to an antenna 188 by lead 189 and tuned to the frequency of the transmitter 183 of the auxiliary unit 157. The output of the receiver 187 is delivered by lead 190 to an amplifier 191 that is provided with a variable resistor R-8 for use in attenuating the output of the amplifier 191. This output is delivered by lead 192 to another earphone 193 which is used for translating messages from the instructor into audible sounds for perception by the student. It also serves to translate the retransmitted signals that are indicative of errant hand movements into audible sounds perceivable by the student.

It is considered evident that the switch 79 may be manipulated so that the perceptible signals generated are those generated by the light signals generator 80. Under such circumstances, the system 150 would be so operated as to avoid the input and monitoring functions contemplated as performable by the instructor.

To realize the full benefit of the training system 150, switch 79 would be so manipulated as to cause the tone signals generator 54 to respond to the outputs developed by the voltage comparators 76 and 78 when the errant hand movements are detected by the circuit 53. As such, when the comparator 76 is enabled by the detection of a positive voltage that exceeds the threshold voltage for the comparator, an output is passed via lead 91, switch 79 and lead 107 to the tone signal generator 97 and the output signal 98 from the generator 97 is passed through the signal modulator 99 in an unmodified condition and via lead 100 to the rf transmitter. Here the tone signal output is applied to the rf carrier and transmitted via the antenna 164 to the auxiliary unit 157 that is carried by the instructor.

In the auxiliary unit 157, the transmission is received through the antenna 167 and passed via lead 169 to the receiver 168. Receiver 168 is tuned to the frequency of the transmitter 165 of the primary unit 160, and here the carrier frequency is removed and the transmitted tone signal passed via lead 171 to the amplifier 170. At the amplifier, the tone signal is amplified and passed via lead 172 to the ear phone 173 for conversion to an audio tone that is perceivable by the instructor. As indicated previously, the output tone signal from the rf receiver 168 may be passed, at the option of the instructor, by lead 175, switch 176, and lead 182 to the rf transmitter 183. Here the tone signal is applied to a carrier with a different frequency than that encountered in the transmission from the primary unit 160 and passed via antenna 184 to the ancillary unit 161.

In the ancillary unit 161, the transmission from the auxiliary unit 157 is received by the antenna 188 and via lead 189 passed to the receiver 187. This receiver 187 is, of course, tuned to the frequency of the carrier for the transmission. Here, the carrier is removed and the transmitted tone signal is passed via lead 190 to the amplifier 191 and thereafter passed, as amplified, via lead 192 to the ear phone 193 for conversion to an audio tone that is perceptible to the student golfer.

If the errant movement of the hand is such as to produce a negative voltage at the comparator 78 and which exceeds the threshold value, the comparator output is passed via lead 92, switch 79, and lead 108 to the tone signal generator. The output is also passed via lead 110 to the signal modulator 99 so that the output signal 98 from the tone signal generator 97 is modified in the modulator and passed via lead 100 to the rf transmitter. From here the transmitted signal may be handled in the auxiliary and ancillary units 157 and 161 in the manner previously described for handling the unmodified signal.

FIGS. 12–14

Figure 12:
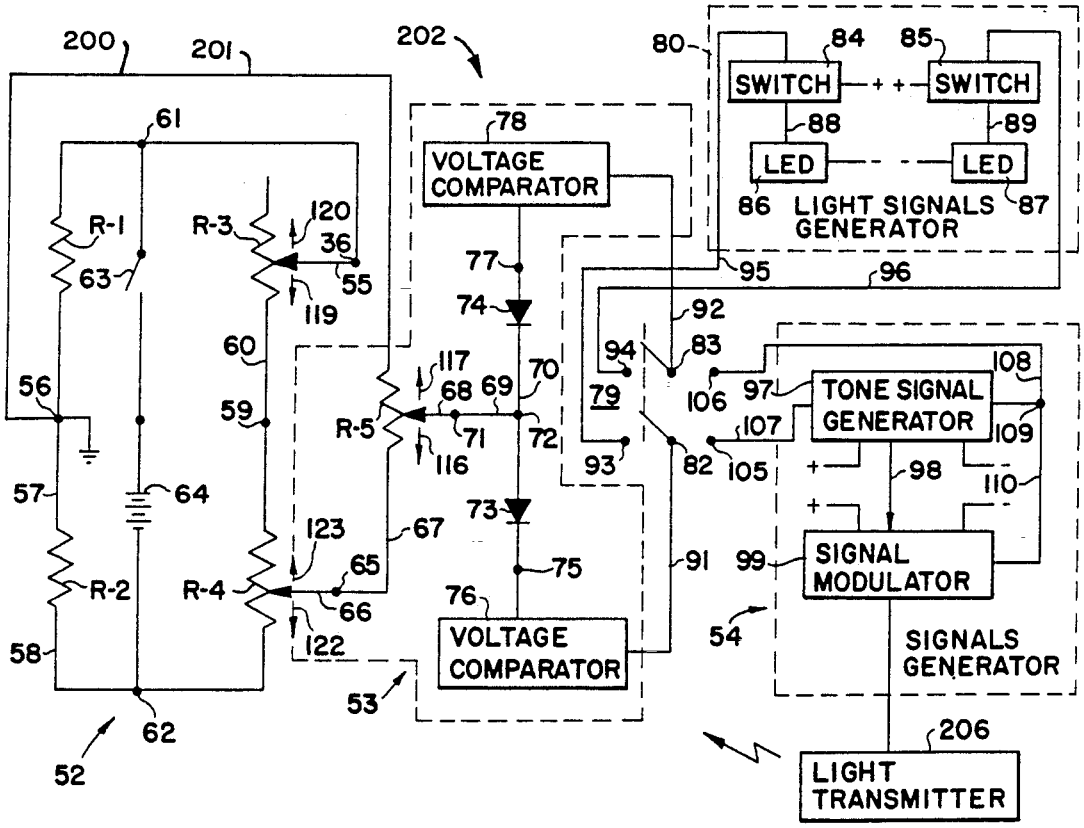
FIG. 12 is a circuit diagram showing the circuit arrangement of certain components of a primary unit of another monitoring device that may be used in the teaching system generally depicted in FIG. 8.
Figure 13:
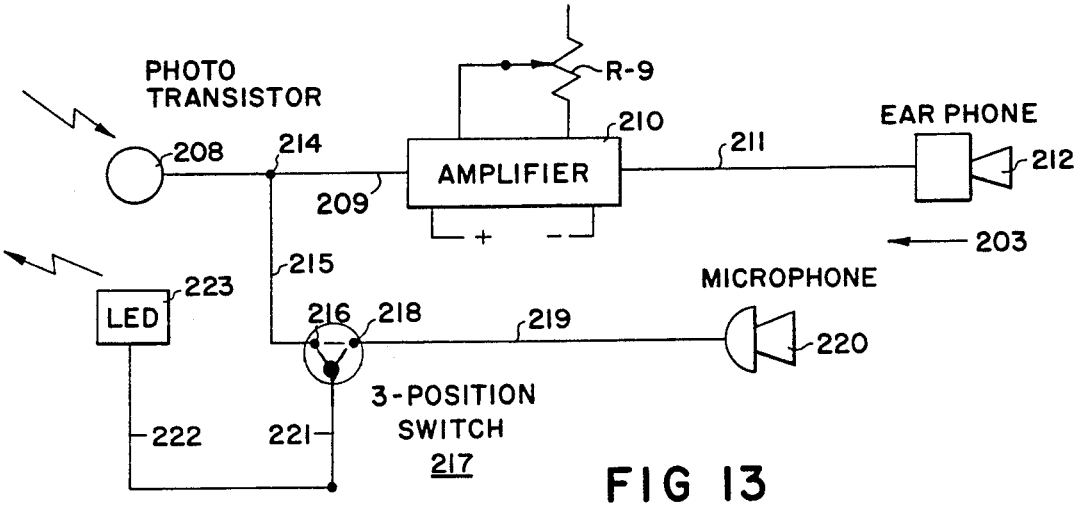
FIG. 13 is a circuit diagram showing the circuit arrangement of certain components of an auxiliary unit of the monitoring device contemplated in FIG. 12.
Figure 14:
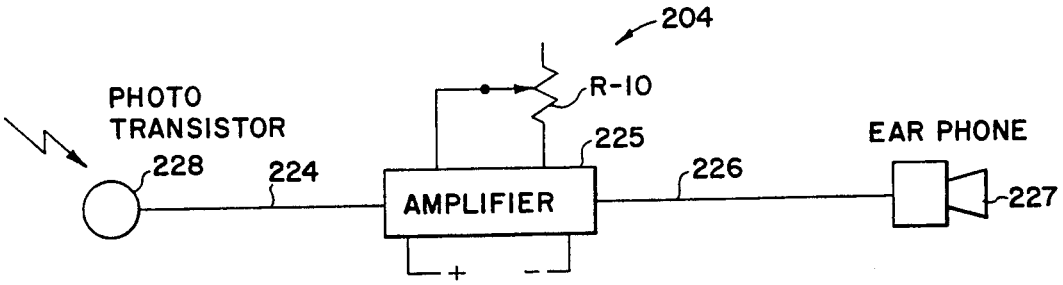
FIG. 14 is a circuit diagram showing the circuit arrangement of certain components of an ancillary unit of the monitoring device contemplated in FIG. 12.

FIGS. 12–14 illustrate the circuit components used in yet another training system in accord with the invention. The training system 200 is substantially similar to the training system depicted in FIGS. 8–11 but differs in that the signals which are transmitted between the primary, auxiliary and ancillary units are transmitted by light transmission systems rather than by rf systems. This has an advantage over the rf transmission systems used in the training system depicted in FIGS. 8–11 in that interference with the light signal transmissions is less likely than when the transmissions are carried out by rf systems.

System 200 has a monitoring device 201 for monitoring the errant hand movements by the golfer as he/she swings the golf club. This device 201 includes a primary unit 202 which is mounted on the golfer's leading arm in a manner similar to that illustrated in FIG. 8 for unit 160 and which includes the circuit components shown in FIG. 12. It also has an auxiliary unit 203 which is incorporated in a head set (not shown) similar to that illustrated for unit auxiliary 157 in FIG. 8, the circuit components of the auxiliary unit 203 being shown in FIG. 13. In addition to the primary unit 202 and auxiliary unit 203, the monitoring device 201 also has an ancillary unit 204 which is incorporated in another head set (not shown) that is similar to that illustrated for ancillary unit 161 in FIG. 8, the circuit components of the ancillary unit 204 being depicted in FIG. 14.

It should be understood that, in addition to the circuit components depicted in FIG. 12, the primary unit 202 includes a case with a sensing element which contacts the back of the hand of the golfers leading arm and which is substantially similar to that shown in FIGS. 1–6. The case in this instance is transparent to the light frequencies used in the transmissions between the primary unit and the auxiliary unit so as to facilitate the transmissions. With this in mind, reference is now made to FIG. 12 and to the circuit components of the primary unit 202 of the monitoring device 201 which are shown therein. The circuit components shown in FIG. 12 which bear the same numerals as used in FIG. 7 are like those shown in FIG. 7 and they function the same way in the circuit arrangement depicted in FIG. 12 for the monitoring device 201 as described with reference to the monitoring device 10 depicted in FIG. 7. Thus, the circuit components 52, 53, 54 and 80 in FIG. 12 are identical to, and function in the same manner as, those circuit components of the monitoring device 10 depicted in FIG. 7.

The signals generator component 54 includes a tone signal generator 97 and a signal modulator 99 like that used in FIG. 7 but the output of the signal modulator 99 is fed via lead 100 to a light emitting diode (LED) 206 that serves as a light signal transmitter used for transmitting the output signal of the tone signals generator 54 to the auxiliary unit. The LED 206 emits light in a narrow band width and the light transmission systems have the advantage over rf transmission system of being practically free of interference from emissions from other light sources whereas rf system are subject to interference from other electronic devices in the proximity of the training area.

The circuit components of the auxiliary monitoring unit 203 are depicted in FIG. 13. Here, the unit 203 is provided with a photo transistor 208 that is appropiately adapted and arranged in the headset to receive the light signal transmissions from the transistor 208 that is appropriately adapted and arranged in the primary unit. The transistor 208 is also appropriately shielded from reception of spurious light signals other than those emanating from the primary unit 202. The transistor 208 is connected by a lead 209 to an amplifier 210 which is equipped with a variable resistor R-9 that is manipulatable to control the attenuation of the signal. The output of the amplifier 210 is fed by lead 211 to an earphone 212 that enables the instructor to monitor the errant movements of the student golfer.

Lead 209 has a wire tap 214 for a lead 215 used in delivering the transistor output to one contact 216 of a three position switch 217. Another contact 218 of the switch 217 is connected by lead 219 to a microphone 220 that may be used by the instructor to directly communicate with the student golfer. The switch blade 221 of switch 217 is connected by lead 222 to another light emitting diode 223 that is used for transmissions from the auxiliary unit 203 to the ancillary unit 204. LED 223 emits light in a narrow light band range which is different from that of the light transmitter 206 used in the primary unit 202 so as to avoid interference with the transmissions from the primary unit 202.

The principal components of the ancillary unit 204 are shown in FIG. 14. The unit 204 includes a photo transistor 228 that is appropriately located in the headset worn by the student golfer. It is designed to receive the light signals emitted by LED 223 and to block other light emissions, such as those from the LED 206 of the primary unit 202. The output of the transistor 228 is delivered by lead 224 to an amplifier 225 that is provided with a variable resistor R-10 for use in attenuating the output of the amplifier 225. This output is delivered by lead 226 to another earphone 227 which is used for the reception by the student of messages that are transmitted from the auxiliary unit 203 by the instructor. Signals indicative of errant hand movements that have been received by the auxiliary unit 203 and retransmitted to the ancillary unit 204 are obviously also transformed to sound perceivable by the student through the use of the earphone 227.

The operation of the training system 200 will be obvious from the foregoing disclosure and is substantially similar to that of the training system depicted in FIGS. 8–11 except that the transmissions of the signals indicative of the errant hand movements between the primary, auxiliary and ancillary units and the voice transmissions between the auxiliary and ancillary units are accomplished through the use of light emissions rather than through the use of an rf carriers.

I claim:

1. A monitoring device for monitoring pivotal hand movements of a golfer about a pivot axis as the golfer swings a golf club, said hand being that connected to the leading arm of said golfer and said pivot axis extending, throughout the monitoring of said hand movements, transversely of said leading arm, generally parallel to the plane of said hand and through the wrist connection of said hand with said leasing arm, said device comprising:

(A) means supported by the golfer's leading arm and having a pivotally moveable sensing element that is biased into contact with the back of said hand for sensing the pivotal position of said hand with respect to said leading arm during pivotal movements of said hand about said pivot axis, said sensing element being pivotally moveable about an axis that is parallel to said pivot axis, (B) a first circuit component for establishing a circuit condition which is equatable to a position for referencing pivotal movements of said hand about said pivot axis, said first circuit component being adapted and arranged to operate under the control of said sensing element and to continuously and without interruption change the circuit condition in response to continuing and uninterrupted pivotal movement of said element, (C) a second circuit component which is connected to said first circuit component for detecting changes in said circuit condition, said second circuit component being responsive to such changes in said circuit condition and having outputs which respectively indicate pivotal movements of said hand about said pivot axis and in opposite pivotal directions from said reference position, and signals generating means operatively connected to said second circuit component and being responsive to the receipt of said outputs for generating humanly perceivable signals which are respectively indicative of the pivotal movements of said hand in said opposite pivotal directions from said reference position.

2. A training system for use by a golf instructor in correcting errant pivotal hand movements during a swing of a golf club by a golfer comprising:

a monitoring device for monitoring said errant hand movements and which includes (A) a primary unit that is carried by the golfer, and (B) an auxiliary unit that is located apart from said primary unit and remote from said golfer;

said primary unit comprising (A-1) means supported by the golfer's leading arm and having a pivotally moveable sensing element that is biased into contact with the back of the hand connected thereto for sensing the pivotal position of said hand with respect to said leading arm during pivotal movements of said hand about a pivot axis, said pivot axis extending transversely of said leading arm, generally parallel to the plane of said hand, and through the wrist connection of said hand with said leading arm throughout such pivotal movements, and said sensing element being pivotally moveable about an axis that is parallel to said pivot axis, (A-2) a first circuit component for establishing a circuit condition which is equatable to a position for referencing pivotal movements of said hand about said pivot axis, said first circuit component being adapted and arranged to operate under the control of said sensing element and to continuously and without interruption change the circuit condition in response to continuing and uninterrupted pivotal movement of said element, (A-3) a second circuit component which is connected to said first circuit component for detecting changes in said circuit condition, said second circuit component being responsive to such changes in said circuit condition and having outputs which respectively indicate pivotal movements of said hand in opposite pivotal directions from said reference position, (A-4) signals generating means operatively connected to said second circuit component and being responsive to the receipt of said outputs for generating signals which are respectively associated with said outputs and indicative of the pivotal movements of said hand in said opposite pivotal directions from said reference position, and (A-5) transmission means responsive to receipt of said associated signals for transmitting the associated signals to said auxiliary unit;

said auxiliary unit being provided for use by a golf instructor in analyzing said pivotal movements of said hand and comprising (B-1) receiving means for receiving the associated signals transmitted by said transmission means, and (B-2) a transducer operating under the control of said receiving means and being responsive to the associated signals received thereby for generating humanly perceivable signals which are respectively indicative of the pivotal movements of said hand in said opposite pivotal directions from said reference position.

3. A training system in accord with claim 2 wherein said transmission means is a radio frequency transmitter, and said receiving means is a radio frequency receiver that is tuned to the radio frequency of said transmission means.

4. A training system in accord with claim 2 wherein said transmission means is a narrow band light signal transmitter, and said receiving means is a light signal receiver that is adapted to receive said narrow light band.

5. A training system for use in correcting errant hand movements during a swing of a golf club by a golfer comprising:

a monitoring device for monitoring said errant hand movements and which includes (A) a primary unit that is carried by the golfer, and (B) an auxiliary unit that is located apart from said primary unit and remote from said golfer;

said primary unit comprising (A-1) means supported by the golfer's leading arm and having a sensing element in contact with the hand connected thereto for sensing the position of said hand during pivotal movement thereof about a pivot axis which is generally parallel to the plane of said hand and through the wrist connection with said arm, (A-2) a first circuit component for establishing a circuit condition which is equatable to a position for referencing pivotal movements of said hand about said pivot axis, said first circuit component being arranged to operate under the control of said sensing element, and said circuit condition being changeable in response to sensed pivotal movements of said hand about said pivot axis, (A-3) a second circuit component which is connected to said first circuit component for detecting changes in said circuit condition, said second circuit component being responsive to such changes in said circuit condition and having outputs which respectively indicate pivotal movements of said hand in opposite pivotal directions from said reference position, (A-4) signals generating means operatively connected to said second circuit component and responsive to the receipt of said outputs for generating signals which are respectively associated with said outputs and indicative of the pivotal movements of said hand in said opposite pivotal directions from said reference position, and (A-5) transmission means responsive to receipt of said associated signals for transmitting the associated signals to said auxiliary unit;

said auxiliary unit comprising (B-1) receiving means for receiving the associated signals transmitted by said transmission means, and (B-2) a transducer operating under the control of said receiving means and being responsive to the associated signals received thereby for generating humanly perceivable signals which are respectively indicative of the pivotal movements of said hand in said opposite pivotal directions from said reference position;

said training system further comprising (C) an ancillary unit which is carried by the golfer;

said auxiliary unit further comprising (B-3) second transmission means operatively connected to said receiving means and responsive to the receipt of associated signals thereby for retransmitting the associated signals to said ancillary unit, and (B-4) switching means manipulatable to operatively disconnect said second transmission means from said receiving means; and said ancillary unit comprising (C-1) second receiving means for receiving the associated signals retransmitted by said second transmission means, and (C-2) second transducer means operating under the control of said second receiving means and being responsive to the associated signals received thereby for generating humanly perceivable signals which are respectively indicative of the pivotal movements of said hand in said opposite pivotal directions from said reference position.

6. A training system for use in correcting errant hand movements during a swing of a golf club by a golfer comprising:

a monitoring device for monitoring said errant hand movements and which includes (A) a primary unit that is carried by the golfer, and (B) an auxiliary unit that is located apart from said primary unit and remote from said golfer;

said primary unit comprising (A-1) means supported by the golfer's leading arm and having a sensing element in contact with the hand connected thereto for sensing the position of said hand during pivotal movement thereof about a pivot axis which is generally parallel to the plane of said hand and through the wrist connection with said arm, (A-2) a first circuit component for establishing a circuit condition which is equatable to a position for referencing pivotal movements of said hand about said pivot axis, said first circuit component being arranged to operate under the control of said sensing element, and said circuit condition being changeable in response to sensed pivotal movements of said hand about said pivot axis, (A-3) a second circuit component which is connected to said first circuit component for detecting changes in said circuit condition, said second circuit component being responsive to such changes in said circuit condition and having outputs which respectively indicate pivotal movements of said hand in opposite pivotal directions from said reference position, (A-4) signals generating means operatively connected to said second circuit component and responsive to the receipt of said outputs for generating signals which are respectively associated with said outputs and indicative of the pivotal movements of said hand in said opposite pivotal directions from said reference position, and (A-5) transmission means responsive to receipt of said associated signals for transmitting the associated signals to said auxiliary unit;

said auxiliary unit comprising (B-1) receiving means for receiving the associated signals transmitted by said transmission means, and (B-2) a transducer operating under the control of said receiving means and being responsive to the associated signals received thereby for generating humanly perceivable signals which are respectively indicative of the pivotal movements of said hand in said opposite pivotal directions from said reference position;

said training system further comprising (C) an ancillary unit which is carried by the golfer; said auxiliary unit further comprising (B-3) second transmission means operatively connected to said receiving means and responsive to the receipt of associated signals thereby for retransmitting the associated signals to said ancillary unit, and (B-4) switching means manipulatable to operatively disconnect said second transmission means from said receiving means, (B-5) microphone means operatively connected to said second transmission means for converting vocal sounds to electronic signals transmissible by said second transmission means, and (B-6) switching means manipulatable to operatively disconnect said second transmission means from said microphone means: and said ancillary unit comprising (C-1) second receiving means for receiving the associated signals retransmitted by said second transmission means and the electronic signals transmitted thereby, and (C-2) second transducer means operating under the the control of said second receiving means and being responsive to the associated signals received thereby for generating humanly perceivable signals which are respectively indicative of the pivotal movements of said hand in said opposite pivotal directions from said reference position and further responsive to the electronic signals transmitted by said second transmission means for converting said electronic signals to humanly perceivable vocal sounds.

7. A training system for use in correcting errant hand movements during a swing of a golf club by a golfer comprising:

a monitoring device for monitoring said errant hand movements and which includes (A) a primary unit that is carried by the golfer, and (B) an auxiliary unit that is located apart from said primary unit and remote from said golfer;

said primary unit comprising (A-1) means supported by the golfer's leading arm and having a sensing element in contact with the hand connected thereto for sensing the position of said hand during pivotal movement thereof about a pivot axis which is generally parallel to the plane of said hand and through the wrist connection with said arm, (A-2) a first circuit component for establishing a circuit condition which is equatable to a position for referencing pivotal movements of said hand about said pivot axis, said first circuit component being arranged to operate under the control of said sensing element, and said circuit condition being changeable in response to sensed pivotal movements of said hand about said pivot axis, (A-3) a second circuit component which is connected to said first circuit component for detecting changes in said circuit condition, said second circuit component being responsive to such changes in said circuit condition and having outputs which respectively indicate pivotal movements of said hand in opposite pivotal directions from said reference position, (A-4) signals generating means operatively connected to said second circuit component and responsive to the receipt of said outputs for generating signals which are respectively associated with said outputs and indicative of the pivotal movements of said hand in said opposite pivotal directions from said reference position, and (A-5) transmission means responsive to receipt of said associated signals for transmitting the associated signals to said auxiliary unit;

said auxiliary unit comprising (B-1) receiving means for receiving the associated signals transmitted by said transmission means, and (B-2) a transducer operating under the control of said receiving means and being responsive to the associated signals received thereby for generating humanly perceivable signals which are respectively indicative of the pivotal movements of said hand in said opposite pivotal directions from said reference position;

said training system further comprising (C) an ancillary unit which is carried by the golfer; said auxiliary unit further comprising (B-3) second transmission means operatively connected to said receiving means and responsive to the receipt of associated signals thereby for retransmitting the associated signals to said ancillary unit, and (B-4) switching means manipulatable to operatively disconnect said second transmission means from said receiving means; and said ancillary unit comprising (C-1) second receiving means for receiving the associated signals retransmitted by said second transmission means, and (C-2) second transducer means operating under the the control of said second receiving means and being responsive to the associated signals received thereby for generating humanly perceivable signals which are respectively indicative of the pivotal movements of said hand in said opposite pivotal directions from said reference position;

said transmission means of said primary unit being a radio frequency transmitter, said receiving means of said auxiliary unit being a radio frequency receiver that is tuned to the radio frequency of the transmission means of said primary unit, said second transmission means being a radio frequency transmitter with a frequency that is operatively distinct from the radio frequency of the transmission means of said primary unit, and said second receiving means being a radio frequency receiver that is tuned to the radio frequency of said second receiving means.

8. A training system for use in correcting errant hand movements during a swing of a golf club by a golfer comprising:

a monitoring device for monitoring said errant hand movements and which includes (A) a primary unit that is carried by the golfer, and (B) an auxiliary unit that is located apart from said primary unit and remote from said golfer;

said primary unit comprising (A-1) means supported by the golfer's leading arm and having a sensing element in contact with the hand connected thereto for sensing the position of said hand during pivotal movement thereof about a pivot axis which is generally parallel to the plane of said hand and through the wrist connection with said arm, (A-2) a first circuit component for establishing a circuit condition which is equatable to a position for referencing pivotal movements of said hand about said pivot axis, said first circuit component being arranged to operate under the control of said sensing element, and said circuit condition being changeable in response to sensed pivotal movements of said hand about said pivot axis, (A-3) a second circuit component which is connected to said first circuit component for detecting changes in said circuit condition, said second circuit component being responsive to such changes in said circuit condition and having outputs which respectively indicate pivotal movements of said hand in opposite pivotal directions from said reference position, (A-4) signals generating means operatively connected to said second circuit component and responsive to the receipt of said outputs for generating signals which are respectively associated with said outputs and indicative of the pivotal movements of said hand in said opposite pivotal directions from said reference position, and (A-5) transmission means responsive to receipt of said associated signals for transmitting the associated signals to said auxiliary unit;

said auxiliary unit comprising (B-1) receiving means for receiving the associated signals transmitted by said transmission means, and (B-2) a transducer operating under the control of said receiving means and being responsive to the associated signals received thereby for generating humanly perceivable signals which are respectively indicative of the pivotal movements of said hand in said opposite pivotal directions from said reference position;

said training system further comprising (C) an ancillary unit which is carried by the golfer;

said auxiliary unit further comprising (B-3) second transmission means operatively connected to said receiving means and responsive to the receipt of associated signals thereby for retransmitting the associated signals to said ancillary unit, and (B-4) switching means manipulatable to operatively disconnect said second transmission means from said receiving means; and said ancillary unit comprising (C-1) second receiving means for receiving the associated signals retransmitted by said second transmission means, and (C-2) second transducer means operating under the the control of said second receiving means and being responsive to the associated signals received thereby for generating humanly perceivable signals which are respectively indicative of the pivotal movements of said hand in said opposite pivotal directions from said reference position;

said transmission means of said primary unit being a narrow band light signal transmitter, said receiving means of said auxiliary unit being a light signal receiver that is adapted to receive the narrow light band of the transmission means of said primary unit, said second transmission means being a narrow band light signal transmitter with a light band that is operatively distinct from the light band of the transmission means of said primary unit, and said second receiving means being a light band receiver that is adapted to receive the narrow light band of said second receiving means.

9. A training system for use in correcting errant hand movements during a swing of a golf club by a golfer comprising:

a monitoring device for monitoring said errant hand movements and which includes (A) a primary unit that is carried by the golfer, (B) an auxiliary unit that is located apart from said primary unit and remote from said golfer, and (C) an ancillary unit which is carried by the golfer;

said primary unit comprising (A-1) means supported by the golfer's leading arm and having a sensing element in contact with the hand connected thereto for sensing the position of said hand during pivotal movement thereof about a pivot axis which is generally parallel to the plane of said hand and through the wrist connection with said arm, (A-2) a first circuit component for establishing a circuit condition which is equatable to a position for referencing pivotal movements of said hand about said pivot axis, said first circuit component being arranged to operate under the control of said sensing element, and said circuit condition being changeable in response to sensed pivotal movements of said hand about said pivot axis, (A-3) a second circuit component which is connected to said first circuit component for detecting changes in said circuit condition, said second circuit component being responsive to such changes in said circuit condition and having outputs which respectively indicate pivotal movements of said hand in opposite pivotal directions from said reference position, (A-4) signals generating means operatively connected to said second circuit component and responsive to the receipt of said outputs for generating signals which are respectively associated with said outputs and indicative of the pivotal movements of said hand in said opposite pivotal directions from said reference position, and (A-5) transmission means responsive to receipt of said associated signals for transmitting the associated signals to said auxiliary unit;

said auxiliary unit comprising (B-1) receiving means for receiving the associated signals transmitted by said transmission means, (B-2) a transducer operating under the control of said receiving means and being responsive to the associated signals received thereby for generating humanly perceivable signals which are respectively indicative of the pivotal movements of said hand in said opposite pivotal directions from said reference position, (B-3) second transmission means operatively connected to said receiving means and responsive to the receipt of the associated signals thereby for retransmitting the associated signals to said ancillary unit, (B-4) switching means manipulatable to operatively disconnect said second transmission means from said receiving means, (B-5) microphone means operatively connected to said second transmission means for converting vocal sounds to electronic signals transmissible by said second transmission means, and (B-6) switching means manipulatable to operatively disconnect said second transmission means from said microphone means; and said ancillary unit comprising (C-1) second receiving means for receiving the associated signals retransmitted by said second transmission means and the electronic signals transmitted thereby, and (C-2) second transducer means operating under the control of said second receiving means and being responsive to the associated signals received thereby for generating humanly perceivable signals which are respectively indicative of the pivotal movements of said hand in said opposite pivotal directions from said reference position and being further responsive to the electronic signals transmitted by said second transmission means for converting said electronic signals to humanly perceivable vocal sounds.

10. A training system in accord with claim 9 wherein said first circuit component of the primary unit has controllable means for varying said circuit condition to establish another circuit condition which is equatable to another hand position for referencing pivotal movements of said hand about said pivot axis.

11. A training system in accord with claim 9 wherein said second circuit component has controllable means for varying the response of the second circuit component to detected circuit condition changes that are indicative of pivotal movements of said hand in each of said opposite directions from said reference position.

12. A training system in accord with claim 9 wherein said second circuit component has controllable means for varying the response of the second circuit component to detected circuit condition changes that are indicative of pivotal movements of said hand in each of said opposite directions from said reference position, and said first circuit component has controllable means for varying said circuit condition to establish another circuit condition which is equatable to another hand position for referencing pivotal movements of said hand about said axis.

13. A training system in accord with claim 9 wherein said first circuit component includes a bridge circuit with parallel legs that are resistively balanced in establishing the reference position.

* * * * *